US006270381B1

(12) United States Patent
Adriaenssens et al.

(10) Patent No.: US 6,270,381 B1
(45) Date of Patent: Aug. 7, 2001

(54) CROSSTALK COMPENSATION FOR ELECTRICAL CONNECTORS

(75) Inventors: Luc Walter Adriaenssens, Red Bank; Amid Ihsan Hashim, Randolph, both of NJ (US); Wayne David Larsen, Indianapolis, IN (US); Bryan Scott Moffitt, Red Bank, NJ (US)

(73) Assignee: Avaya Technology Corp., Miami Lakes, FL (US)

( * ) Notice: Subject to any disclaimer, the term of this patent is extended or adjusted under 35 U.S.C. 154(b) by 0 days.

(21) Appl. No.: 09/611,697

(22) Filed: Jul. 7, 2000

(51) Int. Cl.[7] ..... H01R 23/02
(52) U.S. Cl. ..... 439/676; 439/941; 333/1
(58) Field of Search ..... 439/676, 941, 439/620, 76.1; 333/1, 5, 12, 4

(56) References Cited

U.S. PATENT DOCUMENTS 5,096,442 * 3/1992 Arnett et al. ..... 439/676
5,186,647 * 2/1993 Denkmann et al. ..... 439/395
5,362,257 * 11/1994 Neal et al. ..... 439/676
5,432,484 * 7/1995 Klas et al. ..... 333/1
5,997,358 * 12/1999 Adriaenssens et al. ..... 439/676

* cited by examiner

*Primary Examiner*—Khiem Nguyen
*Assistant Examiner*—Son V. Nguyen

(57) ABSTRACT

Both differential mode-to-differential mode crosstalk compensation and differential-to-common (or common mode-to-differential mode) crosstalk compensation are realized by using a pattern of conductor crossovers in a multi-pair electrical connector dictated by the algorithm $(a-b)^n$ with $n \geqq 3$, where n determines the number of compensating stages and the coefficients of the expanded algorithm in each stage. An electrical connector with a pattern of conductors fashioned with these constraints among several of the pairs of conductors.

9 Claims, 5 Drawing Sheets

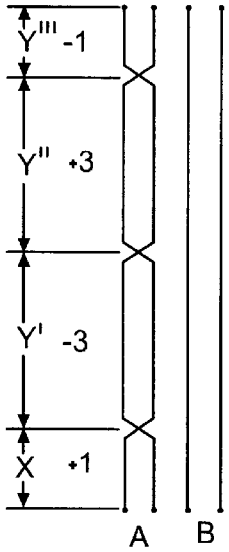
Fig. 5
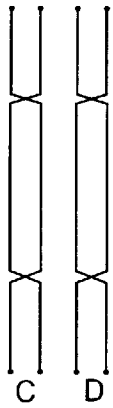
Fig. 6
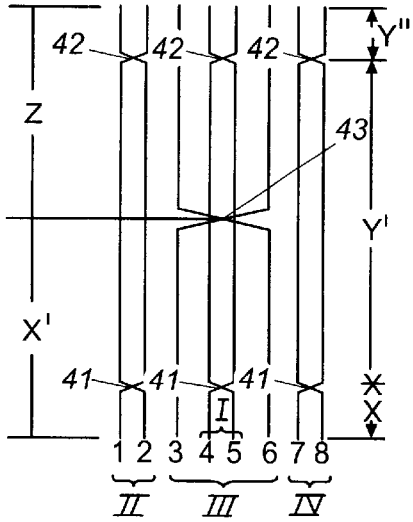
Fig. 7
| DIFFERENTIAL MODE | | | | | | DIFFERENTIAL-TO-COMMON MODE | | | |
|---|---|---|---|---|---|---|---|---|---|
| DM → DM | | | | | | DM → CM | | | |
| I-II | I-III | I-IV | II-III | II-IV | III-IV | I → | II → | III → | IV → |
| + | − | + | − | − | − | + | + | + | + |
| + | + | + | + | − | + | − | − | + | − |
| + | + | + | + | − | + | − | − | + | − |
| + | + | + | + | − | + | − | − | + | − |
| + | − | + | − | − | − | − | − | − | − |
| + | − | + | − | − | − | − | − | − | − |
| + | − | + | − | − | − | − | − | − | − |
| + | + | + | + | − | + | + | + | − | + |
Fig. 8

| DIFFERENTIAL MODE DM → DM | | | | | | DIFFERENTIAL-TO-COMMON MODE DM → CM | | | |
|---|---|---|---|---|---|---|---|---|---|
| 12 | X3 | 14 | 23 | 24 | 34 | 1 → | 2 → | 3 → | 4 → |
| + | − | + | − | − | − | + | + | + | + |
| + | + | + | + | − | + | + | + | − | + |
| + | + | + | + | − | + | + | + | − | + |
| − | + | − | − | − | − | + | − | − | − |
| − | − | − | + | − | + | + | − | + | − |
| + | − | + | − | − | − | + | + | + | + |
| + | − | + | − | − | − | + | + | + | + |
| + | + | + | + | − | + | + | + | − | + |

CROSSTALK COMPENSATION FOR ELECTRICAL CONNECTORS

FIELD OF THE INVENTION

This invention relates to electrical connectors, and, more particularly, to such connectors designed to reduce crosstalk between adjacent pairs comprising different communication paths.

BACKGROUND OF THE INVENTION

The advent and subsequent development of optical communication systems which employ high transmission speeds and frequencies have been responsible for increased development of electrical systems capable of operating at much higher frequencies than heretofore. Inasmuch as, at least for the present, there is still a predominance of electrical systems, for such systems to be competitive, they must operate at the higher frequencies of which optical systems are capable.

In an electrical communication system, it is sometimes advantageous to transmit information (video, audio, data) in the form of balanced signals over a pair of wires (hereinafter "wire-pair") rather than a single wire, wherein the transmitted signal comprises the voltage difference between the wires without regard to the absolute voltages present. Each wire in a wire-pair is capable of picking up electrical noise from sources such as lightning, automobile spark plugs and radio stations to name but a few. Balance is affected by impedance symmetry in a wire-pair as between its individual conductors and ground. When the impedance to ground for one conductor is different than the impedance to ground for the other conductor, then common mode (longitudinal) signals are undesirably converted to differential mode (transverse) signals and vice versa. Additionally, return loss is a reflection of the incoming signal, and it occurs when the terminating impedance does not match the source impedance. Of greater concern, however, is the electrical noise that is picked up from nearby wires that may extend in the same general direction for long distances. This is referred to as crosstalk, and so long as the same noise signal is added to each wire in the wire-pair, then the voltage difference between the wires will remain the same. In all of the above situations, undesirable signals are present on the electrical conductors that can interfere with the information signal. Existing crosstalk compensation schemes in connectors for adjacent pairs of conductors are designed to compensate for differential crosstalk on an idle pair induced, i.e., coupled, from a nearby driven pair. However, most such schemes do not provide for compensation for the differential-to-common mode crosstalk between the driven pair and the idle pair. In the absence of compensation for this latter form of crosstalk, an unbalanced signal is induced in the adjacent pair. Thus, to achieve balance, it is desirable to compensate not only for differential crosstalk caused by a differential input signal, but, also, to compensate for common mode crosstalk caused by a differential input signal and differential mode crosstalk caused by a common mode signal. In U.S. Pat. No. 5,967,853 of Hashim, the disclosure of which is incorporated herein by reference, there is shown a compensation arrangement using capacitors between different pairs of conductors which offset both differential-to-differential crosstalk coupling as well as differential-to-common-mode coupling. The capacitors generally are designed within a printed wiring board (PWB) connected to the connector, and are carefully chosen as to value to produce the desired amount of compensation (or coupling) between discrete pairs. In any such compensation arrangement, design techniques require good judgement and are applicable only to achieve a certain level of balance performance for the specific parameters of the signal transmission.

In U.S. Pat. No. 5,186,647 to Denkmann et al. and U.S. Pat. No. 5,997,358 of Adriaenssens et al., the disclosures of which are incorporated herein by reference, there are shown connectors wherein compensating crosstalk is introduced by establishing stages wherein predetermined magnitudes and phases of compensating crosstalk are generated. The stages are created by cross-overs of certain conductors within the connector or by appropriately placed capacitors. Both patents disclose differential crosstalk compensation but do not address the differential-to-common mode crosstalk, as is done in the Hashim patent.

SUMMARY OF THE INVENTION

The present invention is an arrangement for the conductors within a connector, preferably, but not necessarily, using the crossover techniques disclosed in the Denkmann et al. and Adriaenssens et al. patents, wherein there are n stages of compensation, where $n \geqq 3$, and is based upon the algorithm $$(a-b)^n \tag{1}$$

When the algorithm is solved for any value of n of three (3) or more, the coefficients of the individual terms give the amplitudes of the crosstalk components, the first of which is the original crosstalk and the rest being compensation in each of the several stages of compensation. Thus, for $$(a-b)^3=a^3-3a^2b+3ab^2-b^3 \tag{2}$$

the coefficients are +1, −3, +3, −1. As is pointed out in the analysis given in the Adrienssens et al. patent, more than one stage is necessary to compensate for the phase differences of the generated crosstalk and the compensating crosstalk. The algorithm is applicable to values of n of three (3) or more and, hence, three or more stages, and the coefficients of the terms dictate the magnitudes and polarities of the compensation while the exponent n is determinative of the number of stages. The greater the value of n, the more stages and better compensation result. However, there are practical limits to the value of $n \geqq 3$, as will be apparent hereinafter.

In an illustrative embodiment of the invention a connector having eight leads forming four pairs, I, II, III, and IV, has the conductors configured for optimum crosstalk compensation involving the first and third pairs, I and III, which, as will be apparent hereinafter, are the most important because, during normal connector usage, they exhibit the most crosstalk. Crosstalk between pairs II–III and III–IV are also important. In accordance with the algorithm (1) and for n=3, the pair II (leads 1 and 2) has two crossovers of the type shown for example in the Denkmann et al. patent, as do pairs I (leads 4 and 5) and IV (Leads 7 and 8). The pair III (leads 3 and 6) has one crossover, which, in interaction with pairs I, II, and IV produces a sum of three stages as dictated by algorithm (1) for n=3 and the amplitudes of compensating crosstalk in the several stages conform to the coefficient values of algorithm (1) and to the polarities. As will be more apparent from the detailed discussion hereinafter, there are, within the connector, three stages of differential mode coupling between pairs I and III, II and III, and III and IV, all of which couplings produce, as an end result, vector sums for optimum phase, as discussed in the Adriaenssens et al. patent and magnitudes of compensation for minimizing crosstalk.

The principles of the invention which involve the algorithm (1) are applicable to other connector arrangements, as will be discussed hereinafter, and to other possible configurations wherein crosstalk among pairs of leads presents problems.

The principles and features of the present invention will be more readily understood from the following detailed description, read in conjunction with the accompanying drawings.

DESCRIPTION OF THE DRAWINGS

FIG. 5 is a diagram of a wiring configuration for differential mode-to-differential mode crosstalk compensation;

FIG. 6 is a diagram of a wiring configuration for differential mode-to-common mode crosstalk compensation;

FIG. 7 is a diagram of a first conductor assembly configuration in accordance with the present invention;

FIG. 8 is a table demonstrating the crosstalk compensation for the conductor arrangement of FIG. 7;

DETAILED DESCRIPTION

Figure 1:
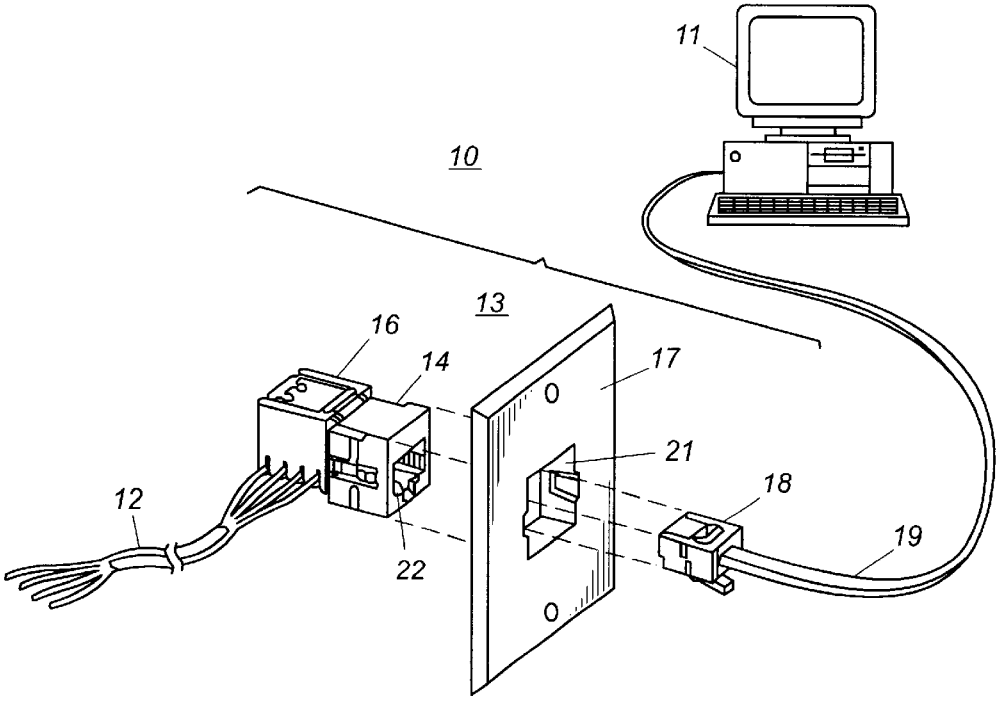
FIG. 1 is a perspective view of the use of a modular connector for interconnecting high speed station hardware with an electrical communication cable.

FIG. 1 discloses an interconnection between high speed station hardware 11 and a cable 12 having, for example, eight wires constituting four wire pairs. Interconnection between hardware 11 and cable 12 is by use of a standard connection 13 comprising a jack frame 14, connector 16, wall plate 17 and modular plug 18 which carries electrical signals to and from hardware 11 via cable 19. Wall plate 17 serves as a mounting member for frame 14 and connector 16 into which plug 18 is insertable through opening 21 which contains, in locked position, frame 14.

Figure 2:
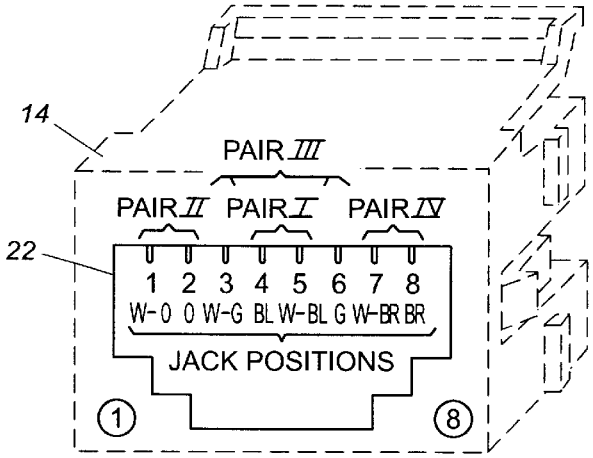
FIG. 2 shows the jack contact wiring assignments for an eight (8) position telecommunications outlet (T568B) as viewed from the front.

Terminal wiring assignments for plugs 18 and jack frame 14 are specified in Commercial Building Telecommunications Wiring Standards, and are shown in FIG. 2. As can be seen in FIG. 2, the wires 1 and 2 comprise wire-pair II, wires 4 and 5 comprise wire-pair I, wires 3 and 6 comprise wire-pair III, and wires 7 and 8 comprise wire-pair IV. This standard for wiring assignments leads to problems at higher frequencies. Consider that wire-pair III straddles wire-pair I, looking into opening 22 of jack frame 14. If the jack frame 14 and connector 16 include electrical paths that are parallel to each other and in the same approximate plane, there will be crosstalk between pairs I and III which increases with increasing frequency, which is unacceptably high at frequencies above 1 Mhz.

Figure 3:
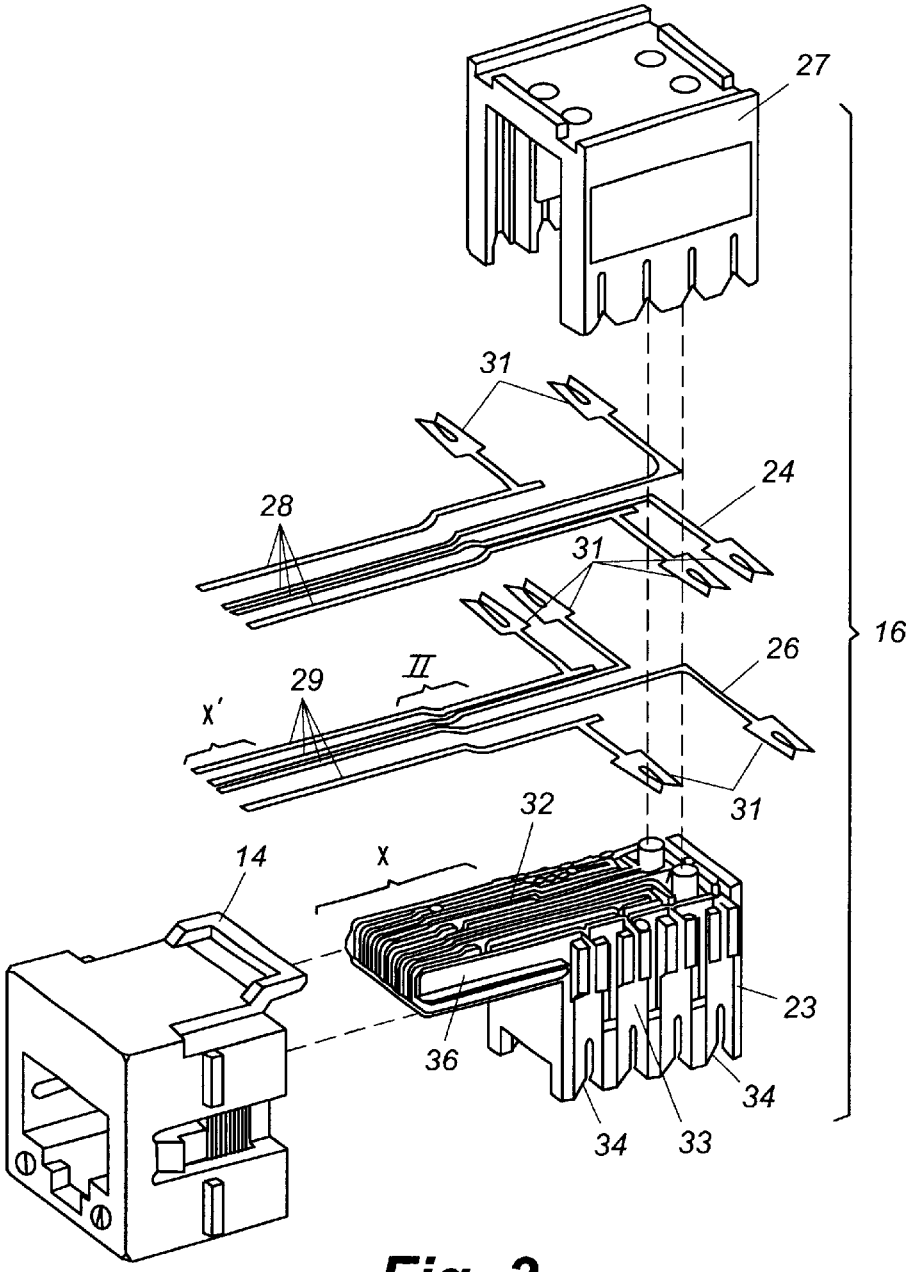
FIG. 3 is an exploded perspective view of a high frequency electrical connector of the type used in the present invention.

In FIG. 3 there is shown an exploded perspective view of a high frequency electrical connector 16 and jack frame 14. Connector 16 comprises a spring block 23, lead frames 24 and 26 and a cover 27. Lead frames 24 and 26 comprise four flat elongated conductive elements 28 and 29 respectively, which terminate, at one end, in insulation displacement connectors 31. The top surface of spring block 23 has a series of grooves 32 which are configured to hold lead frames 24 and 26 in the pattern shown in FIG. 4 wherein the metallic leads which form pairs I, II, and IV each has a single non-contacting crossover in the region X. This is the conductor configuration shown in the Denkmann et al. Patent.

In assembly, the insulation displacement connectors 31 are folded over the walls 33 of block 23 with the slots therein coinciding with conductor receiving slots 34. The other ends of the conductors 28 and 29, at region X' are bent around the nose 36 of spring block 23 to form the spring contacts within the modular jack frame 14 into which spring block 23 is inserted after the cover 27 has been attached thereto.

As was pointed out in the foregoing, there have been, and are, several arrangements of conductors for reducing crosstalk. Most of these arrangements have been based upon empirical determinations, and differ for different frequency ranges and also from each other.

Figure 4:
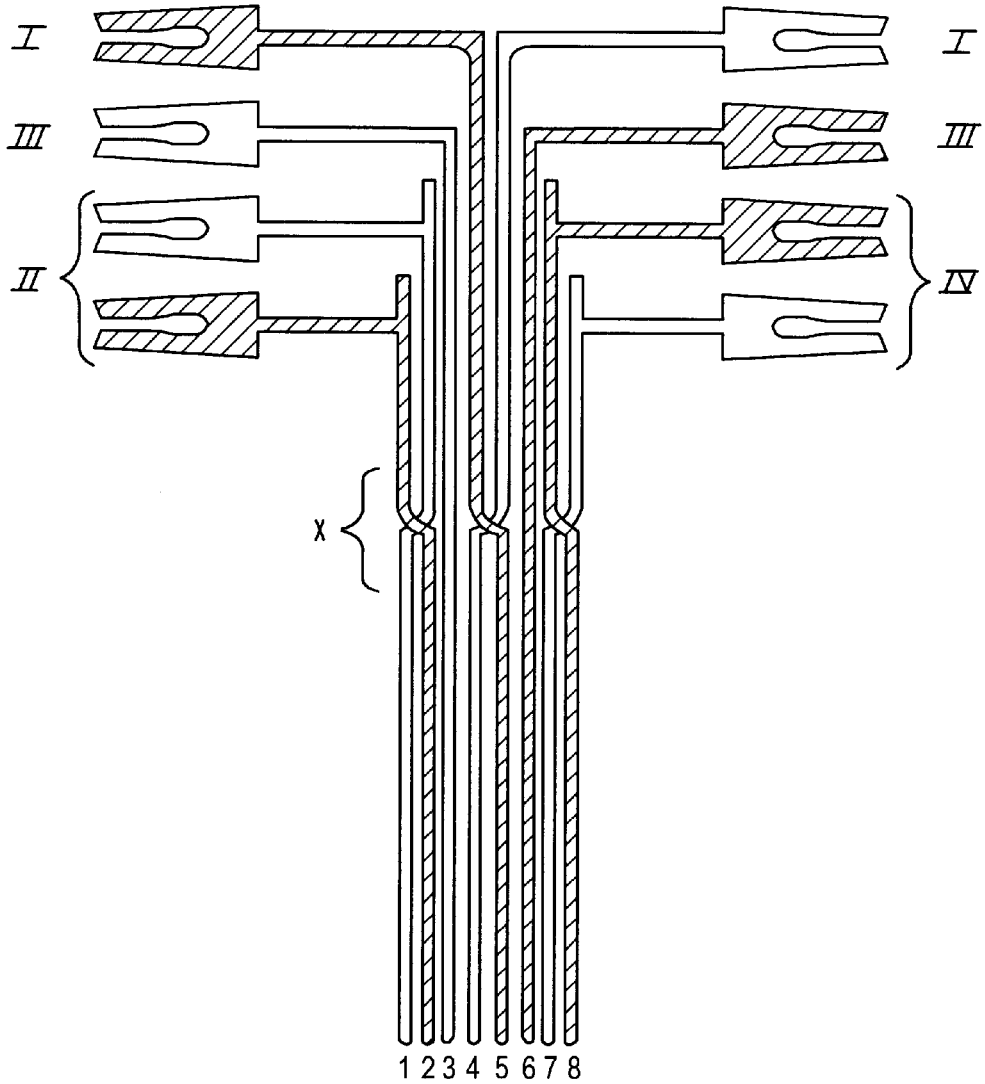
FIG. 4 is a plan view of the lead frames of a prior art conductor configuration as used in a connector of the type shown in FIG. 3.

The remainder of this discussion is directed to the principles of the present invention and their application to, for example, a connector of the type shown in FIGS. 3 and 4, in general differing therefrom in the arrangement of the conductors of the several wire pairs. It is to be understood, however, that these principles are applicable to other connector configurations and to other crosstalk generating apparatus where it is desired to reduce substantially the crosstalk and the deleterious effects thereof.

FIG. 5 shows, respectively, a three stage differential-to-differential compensating arrangement for wire pairs A and B. Crosstalk is generated between pairs A and B in section X of pair A. For ease of understanding, this has been indicated as having a magnitude of +1 units. The three stages of compensation are labeled $Y^1$, Y", and Y'" and have magnitudes of compensating crosstalk within the stages as −3 units, +3 units and =1 unit. These values, along with the value −1 of section X correspond to the coefficients of the terms of algorithm (1) for n=3, and the net result is differential-to-differential crosstalk compensation for pairs A and B. In FIG. 6 there is shown, for pairs C and D, an arrangement of crossovers wherein there is differential-to-common or common-to-differential crosstalk compensation regardless of whether the signal is launched in pair C or pair D. There is however, no differential-to-differential compensation.

FIG. 7 is a diagram of the routing of the conductors in a connector of the type shown in FIG. 3 for compensating for differential-to-differential mode crosstalk and for differential-to-common or common-to-differential mode crosstalk. The eight conductors are numbered 1 through 8, and the orientation of pairs I, II, III, and IV is as shown in FIG. 2, the standard protocol. As can be seen from FIG. 7, pairs I and III have a compensation system per the disclosed algorithm where n=3. Starting from the bottom of the drawing, the section between the bottom and the first crossover 41 in pair I is for the initial crosstalk X. The section between the first crossover 41 in pair I and the crossover 43 in pair III is three units long, giving the first stage of compensation of −3 units. The section between the crossover 43 in pair III and the second crossover 42 in pair I is also three units long giving the second compensating stage +3. The section between the second crossover 42 in pair I and the top of the diagram is one unit long giving the final compensating stage of value −1. Between pairs II and III, and between pairs IV and III, the same compensation arrangement exists. Pairs I and II, pairs I and IV, and pairs II and IV, do not have compensation in the differential-to-differential mode, in this arrangement. Hence, the most troublesome differential pair is compensated for by 3 stage compensation. FIG. 8 is a table which shows this effect.

Coupling from the differential mode of a first pair into the common mode of a second pair is reciprocal with coupling from the common mode of the second pair into the differential mode of the first pair, differing only by a ratio related to termination impedances, thus it is only necessary to consider a differential mode launch to capture all the necessary information. In common mode pickup, crossovers on the receiving pair are irrelevant, hence one only considers crossovers on the launch pair, hence the places where crossovers exist on the launch pair divide the segments into lengths of the ratio of the coefficients of expanded algorithm (1). In the conductor configuration (also known as lead frame) of FIG. 7, pair III is considered as the launch pair and has one stage (n=1) of compensation, effectively compensating for common mode crosstalk. Thus, crossover 43 facilitates three stage differential-to-differential mode compensation (n=3) and one stage differential-to-common or common-to-differential mode compensation.

Figures 9, 10:
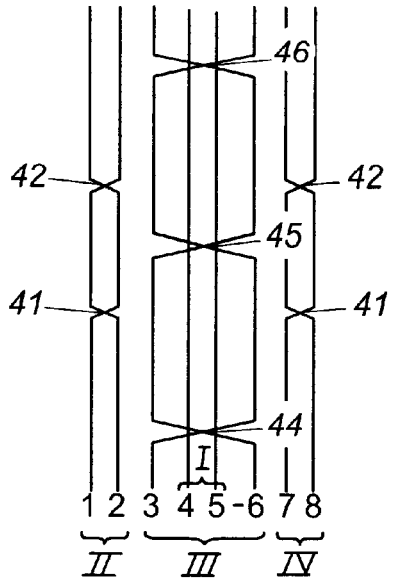
FIG. 9 is a diagram of a second conductor assembly configuration in accordance with the present invention.
FIG. 10 is a table demonstration the crosstalk compensation for the conductor arrangement of FIG. 9.

FIG. 9 is a diagram of the routing of the conductors in another illustrative embodiment of the invention, and FIG. 10 is a table showing the crosstalk effects on the several pairs in the arrangement of FIG. 9. As can be seen in FIG. 9, pairs II and IV each have two crossovers 41 and 42. However, in this embodiment, pair I has no crossovers. Pair III, straddling pair I, has three crossovers 44, 46 and 47, thereby having three stages of compensation with respect to pair I. As a consequence, as seen in the table of FIG. 10, there is substantially complete compensation for the differential mode-to-common mode crosstalk. From the table in FIG. 10 it can been seen that for pairs I–III, II–III, and III–IV, there is a substantial compensation in the differential mode-to-differential mode compensation. Thus, as with the arrangement of FIG. 7, pair III is configured to produce differential mode-to-differential mode compensation and differential mode-to-common mode compensation so as to produce a balanced connection.

The embodiments of the invention shown in FIGS. 7 and 9 both illustrate the results achieved by use of the algorithm (1) where n=3. It is to be understood that n may have values greater than 3, thereby requiring more stages of compensation with magnitudes dictated by the values of the coefficients in the several terms, with a consequent even finer amount of compensation, without departure from the spirit and scope of the present invention.

It is to be understood that the various features of the invention might be incorporated into other types of connectors or connections, and that other modifications or adaptations might occur to workers in the art. All such variations and modifications are intended to be included herein as being within the scope of the present invention as set forth. Further, in the claims hereinafter, the corresponding structures, materials, acts, and equivalents of all means or step-plus-function elements are intended to include any structure, materials, or acts for performing the functions in combination with other elements as specifically claimed.

What is claimed is:

1. An electrical connector for providing predetermined amounts of compensating signals for approximately canceling a like amount of an offending signal at a given frequency, the connector having a plurality of pairs of metallic conductors forming an interconnection path between input and output terminals of the connector, at least some of the pairs being adjacent each other, the connector further including a first compensation stage at a first location along the interconnection path wherein compensating signals having a first magnitude and polarity are coupled between the pairs and second compensation stage at a second location along the interconnection path wherein compensating signals having a second magnitude and polarity are coupled between the pairs;

at least a third compensation stage at a third location along the interconnection path wherein compensating signals having a third magnitude and polarity are coupled between the pairs;

wherein the magnitudes and polarities of the compensating signal in the several stages are given by the algorithm:

$$(a-b)^n$$

where the values and signs of the coefficients of the expanded algorithm determine the magnitudes and polarities of compensating the signals in the stages and wherein n is equal to the member of compensation for values of $n \geqq 3$.

2. An electrical connector as claimed in claim 1 wherein said stages are configured to provide differential mode-to-differential mode crosstalk compensation in said connector.

3. An electrical connector as claimed in claim 2 wherein said stages are configured to provide differential mode-to-common mode crosstalk compensation on at least one pair combination.

4. An electrical connector as claimed in claim 1 wherein the compensating signal provided by each of the several stages is effected by a change in the position of the electrical conductors in at least one of the pairs relative to each other, in a manner to reverse the polarity of the signal in the succeeding stage in said pair.

5. An electrical connector as claimed in claim 4 wherein each change in position of the electrical conductors comprise a non-conductive crossover of the two conductors of a pair.

6. An electrical connector as claimed in claim 1 having four pairs of conductors I, II, III and IV, wherein there are three stages of compensation between differential mode signals in pairs I and III, three stages of compensation between pairs II and III, and three stages of compensation between pairs III and IV, each of said stages being defined by non-conductive crossovers of the conductors in interacting pairs.

7. An electrical connector as claimed in claim 6 wherein the compensation between the pairs also includes differential mode-to-common mode compensation.

8. An electrical connector as claimed in claim 7 wherein pair III has a single non-conductive crossover for providing differential mode-to-common mode compensation.

9. An electrical connector as claimed in claim 1 having four pairs of conductors I, II, III, and IV, wherein pair III has three crossovers, and pair I has no crossovers, thereby producing three stages of differential mode-to-differential mode compensation and three stages of differential mode-to-common mode compensation.

* * * * *